US006011481A

United States Patent [19]

Luther et al.

[11] Patent Number: 6,011,481

[45] Date of Patent: Jan. 4, 2000

[54] WALKING CANE WITH SENSORS

[76] Inventors: Arch Luther, P. O. Box 92 3800 Muniz Ranch Rd., Jenner, Calif. 95450; Abbas M. Husain, 8 Bunning Dr., Voorhees, N.J. 08043

[21] Appl. No.: 09/176,655

[22] Filed: Oct. 21, 1998

[51] Int. Cl.[7] ..... G08B 21/00

[52] U.S. Cl. ..... 340/686.1; 340/665; 135/66; 135/67

[58] Field of Search ..... 340/681.1, 665, 340/689, 666, 407.1, 944; 200/61.85; 135/65, 66, 67

[56] References Cited

U.S. PATENT DOCUMENTS

| | | | |
|---|---|---|---|
| 3,158,162 | 11/1964 | Reel . | |
| 3,158,851 | 11/1964 | Ruthven . | |
| 3,251,371 | 5/1966 | Croker . | |
| 3,546,467 | 12/1970 | Benjamin . | |
| 3,996,950 | 12/1976 | Mier . | |
| 4,280,204 | 7/1981 | Elchinger . | |
| 4,858,125 | 8/1989 | Washizuka et al. | 364/413.01 |
| 5,097,856 | 3/1992 | Chi-Sheng . | |
| 5,554,975 | 9/1996 | Hall et al. | 340/573 |

*Primary Examiner*—Jeffery A. Hofsass
*Assistant Examiner*—Hung T. Hguyen
*Attorney, Agent, or Firm*—Robert D. Thompson

[57] ABSTRACT

The present invention is an improvement over existing walking canes to be used by people with physical impairments that require them to have additional support while walking. The present invention provides a means by which an imbalance in the weight distribution among the multiple legs of the cane is sensed and transmitted to the user. The walking cane with sensors comprises a handle, a vertical shaft and multiple legs or feet. Each of the legs is equipped with electronic stress or load sensors which are coupled to an electronic processing module. The processing module evaluates the input from the cane legs and activates a warning to the user in the event that the load sensors on the legs detect a load distribution indicative of an approaching unstable situation. The user can then stop and probe with the cane until a stable position is found.

6 Claims, 5 Drawing Sheets

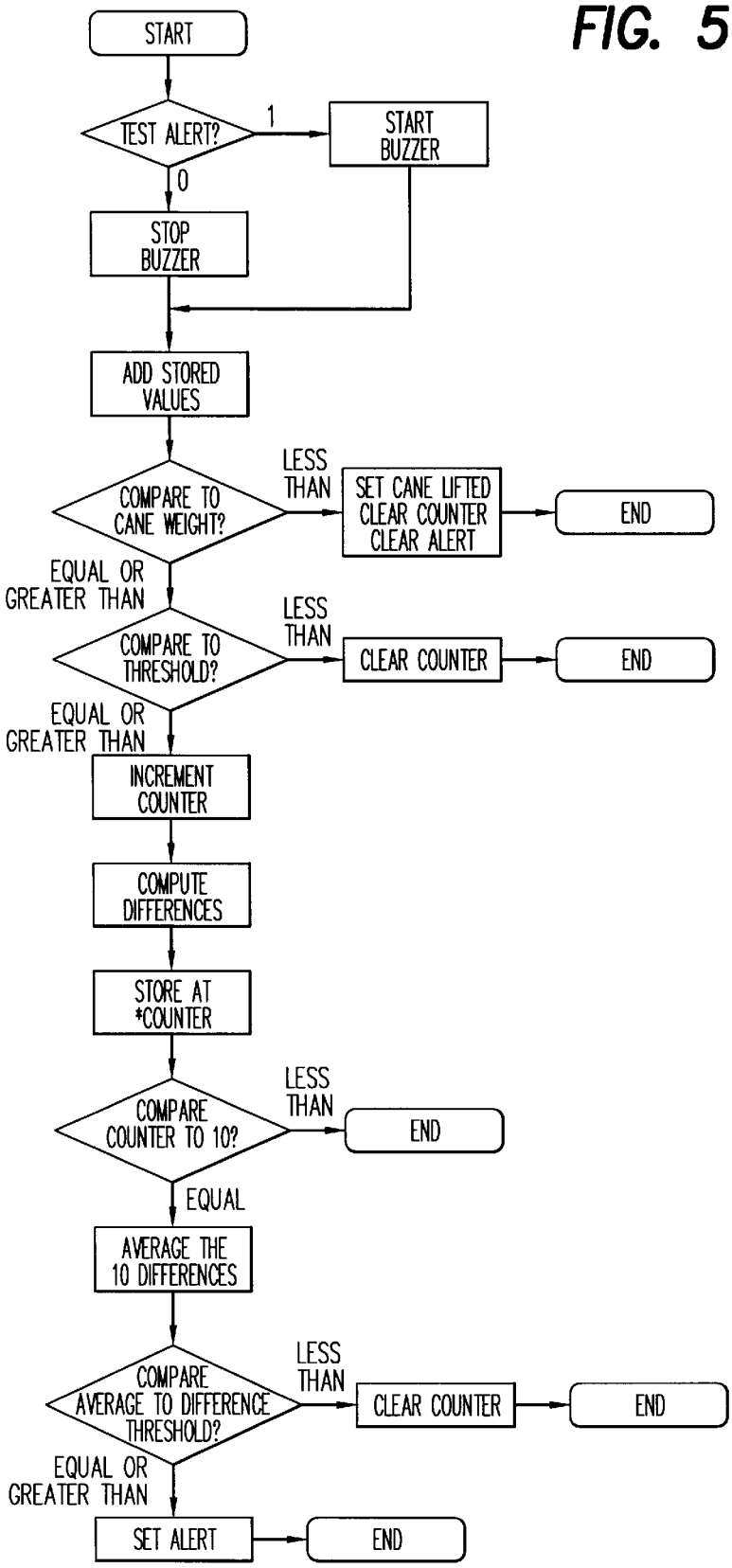
FIG. 5
START
TEST ALERT?
1
START BUZZER
0
STOP BUZZER
ADD STORED VALUES
COMPARE TO CANE WEIGHT?
LESS THAN
SET CANE LIFTED
CLEAR COUNTER
CLEAR ALERT
END
EQUAL OR GREATER THAN
COMPARE TO THRESHOLD?
LESS THAN
CLEAR COUNTER
END
EQUAL OR GREATER THAN
INCREMENT COUNTER
COMPUTE DIFFERENCES
STORE AT *COUNTER
COMPARE COUNTER TO 10?
LESS THAN
END
EQUAL
AVERAGE THE 10 DIFFERENCES
COMPARE AVERAGE TO DIFFERENCE THRESHOLD?
LESS THAN
CLEAR COUNTER
END
EQUAL OR GREATER THAN
SET ALERT
END

WALKING CANE WITH SENSORS

BACKGROUND OF INVENTION

Walking canes are used by people with physical impairments that require them to have additional support while walking. They are also used by visually impaired people to evaluate the surface before them as they walk. This invention applies in both cases and offers improvements in both the stability and sensing ability of a walking cane.

Typical prior art walking canes provide a shaft that reaches from a convenient hand holding height down to the ground next to or in front of the walker. A single or multi-legged foot supports the cane on the ground and a handle provides easy control of the cane by the user. Such canes are inexpensive and reliable but their ability to sense the walking environment is limited to what is transmitted up to the user's hand by the rigid foot, shaft and handle.

Other prior art devices have been developed for sensing the area ahead of a walker using radar principles and computers for analysis and warning to the walker when interfering objects are sensed ahead. The high expense of these devices place them out of the reach of most people who need a walking cane.

The instant invention provides an improved but still inexpensive walking cane that allows the walker to be much more sensitive to walking conditions. The objectives of the invention are to:

1. Provide support to the user and increase his or her sensitivity to dangerous walking conditions;

2. Warn the user when the cane is placed on uneven or unstable ground that might cause loss of balance;

3. Provide these features at a price that is affordable for most cane users.

CROSS-REFERENCE TO RELATED APPLICATIONS

None.

SUMMARY OF THE INVENTION

This invention is an improved walking cane that includes electronic sensing of the load distribution among a multiplicity of cane legs in order that a warning may be provided to the cane user when the load distribution approaches the point of instability as the user applies his or her weight to the cane.

BRIEF DESCRIPTION OF SEVERAL VIEWS OF THE DRAWINGS

FIG. 5 is a flow chart of the stability sensing algorithm.

DETAILED DESCRIPTION OF THE INVENTION

Figure 1:
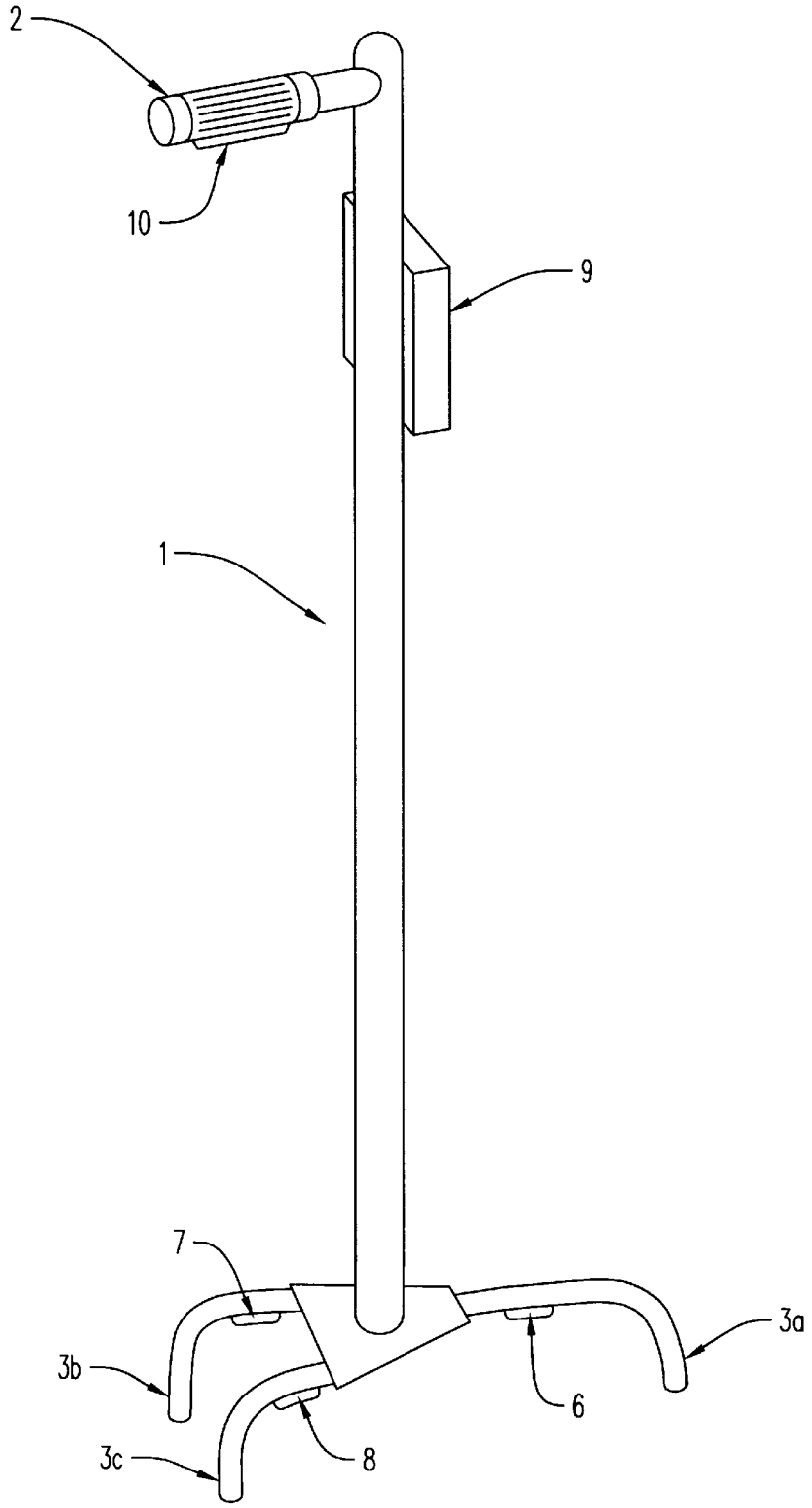
FIG. 1 is a drawing of one embodiment of a cane as disclosed by this invention.

A more complete understanding of the invention and its advantages will be apparent by consideration of FIG. 1 which shows a three-legged walking cane embodying the invention. A vertical shaft 1 is equipped with a handle 2 and a base or foot 3, which has three legs 3*a,* 3*b* and 3*c*.

The foot 3 is equipped with resistive strain gages or other types of load sensors 6, 7 and 8 on the legs 3*a,* 3*b* and 3*c* respectively. The sensors are connected to an electronics module 9 by way of wires that may be carried inside the cane shaft. One embodiment may include the placement of the entire electronics module within the cane shaft. The electronics module 9 is battery powered and operates a warning buzzer 10 on the handle 2. Alternatively, warnings may be conveyed by other means such as a loudspeaker.

In use, the load sensors measure the load placed on each leg and communicate the values continuously to the electronics module 9, which may contain a hardware logic processor or a microcomputer to process the values according to an algorithm as set forth below. When an unstable condition is identified by the electronics module, the warning buzzer 10 is operated to warn the user that he or she is about to enter an unstable condition. The user would then stop and probe with the cane until a stable position is found.

Figure 2:
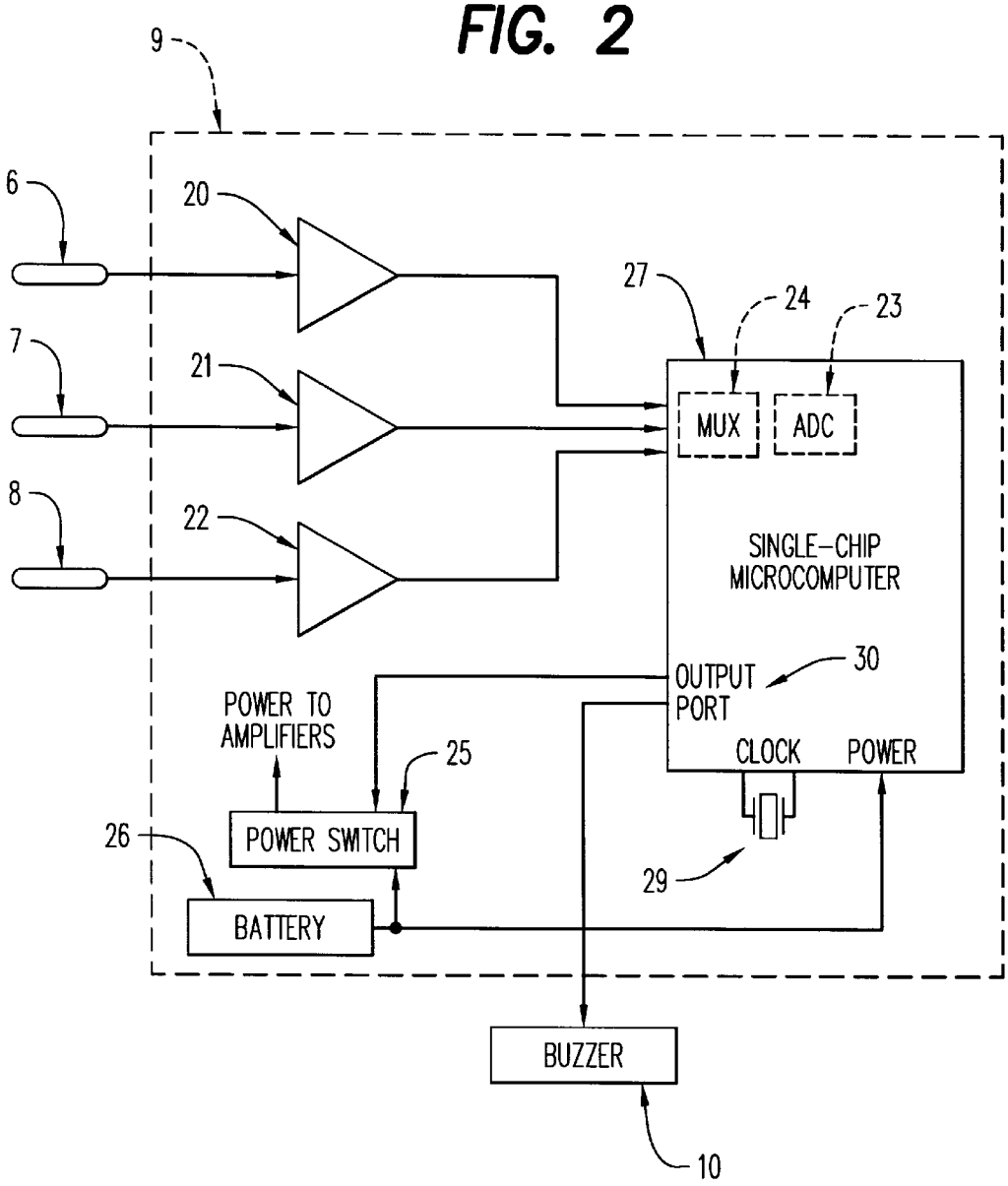
FIG. 2 is a block diagram of the electronic units on the cane.

Referring to the block diagram of FIG. 2, one embodiment of the electronics module 9 could contain a single chip microcomputer 27 that is interfaced to the load sensors through sensing amplifiers 20, 21 and 22. The amplifiers amplify and calibrate the outputs of the sensors up to a level suitable for coupling to the microcomputer 27, which contains a multiplexed module 24 and an analog-to-digital conversion (ADC) module 23. The microcomputer runs at a clock frequency determined by crystal 29.

Figure 3:
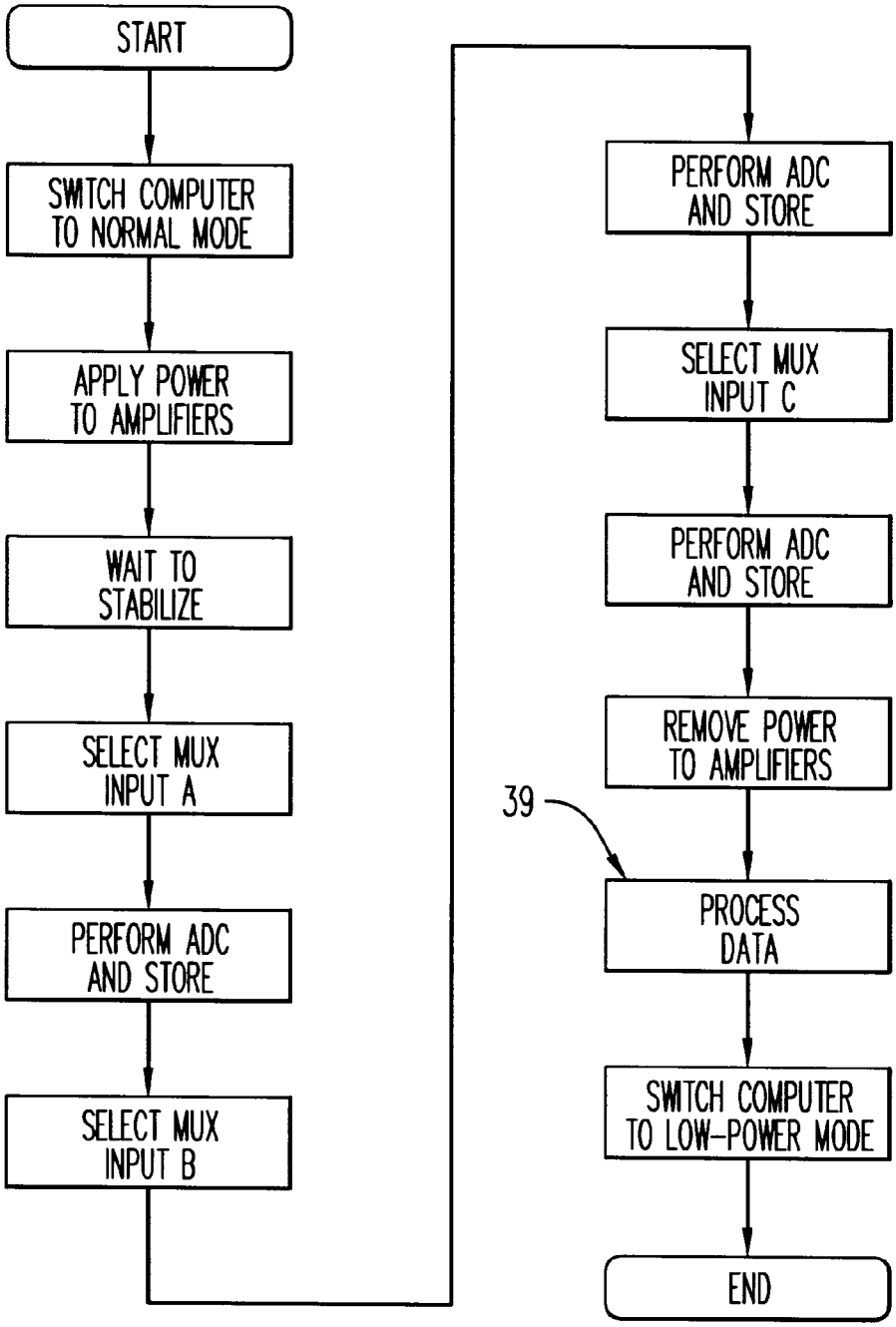
FIG. 3 is a flow chart for the capture of the strain gage signals.

Since the electronic module runs from batteries, it is important to conserve battery power so batteries do not wear out too quickly. That is accomplished by pulsing the power to the load sensing circuits so that they are powered for only a fraction of the time that the cane is in operation. The microcomputer is also put into a low power mode where only the internal timer circuits operate. Under control of the microcomputer's timer, power is pulsed on periodically and the capture and process cycle is performed as shown in FIG. 3. This might occur, for example, 100 times per second.

Referring to FIG. 3, the cycle begins with the microcomputer switching to its normal running mode and applying battery power to the strain gage amplifiers through the power switch 25 in FIG. 2. The power switch is controlled by one line of the output port 30 of the microcomputer. Then the microcomputer timer causes a delay to allow the sensing circuits to stabilize before reading their outputs.

Reading the sensor values is accomplished by selecting them one at a time with the microcomputer's multiplexer, which passes each value to the ADC of the microcomputer. The ADC results from each reading are stored in separate memory locations for use later in the "process data" 39 part of the cycle. After all three values have been read, converted and stored, power is removed from the amplifiers, but the microcomputer remains in run mode until the "process data" 39 cycle is complete.

Figure 4:
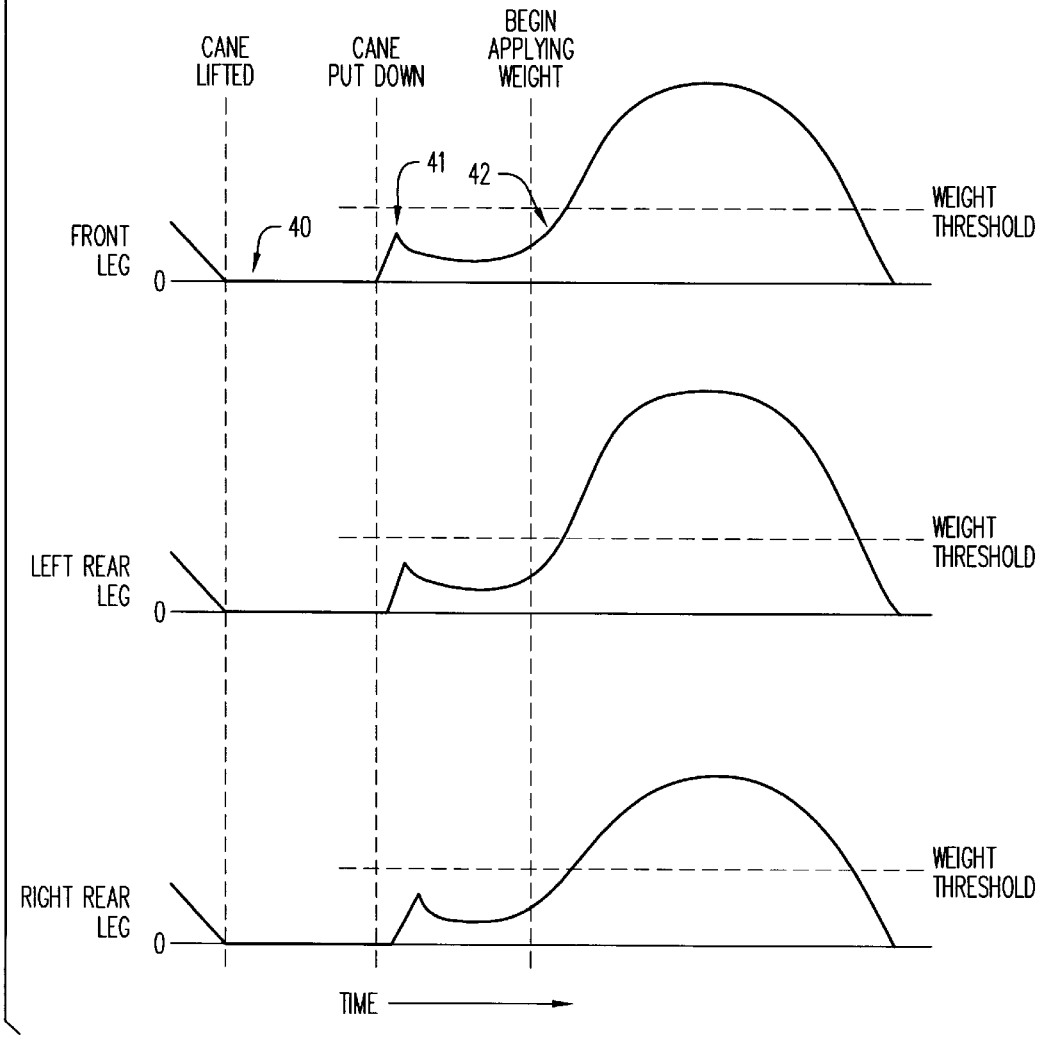
FIG. 4 is a graph of the loads on a multi-legged cane during walking.

The "Process Data" algorithm 39 may be further understood by reference to FIG. 4, which shows how the load on the legs of the three-legged cane of FIG. 1 varies during walking. The walker begins a new step by lifting the cane and moving it ahead a suitable distance. During this action, of course, there is no load on the cane legs as shown at 40 in FIG. 4. When the cane is put down in the new location, there may be momentary excess load because of the cane's inertia, as shown at 41 in FIG. 4. This is followed by a period of time where the only load is the cane's own weight, until the walker begins to apply his or her weight to the cane, as at 42 in FIG. 4. Then, the cane leg loads increase up to a level determined by how much of the walker's weight is applied to the cane. During this part of the cycle, the cane's electronic module 9 senses the load distribution for excessive unbalance, which would indicate an unstable situation. If the unbalance of the load is too great and persists for too long, the walker is given a warning through a buzzer in the handle or other suitable warning device.

FIG. 5 is a flow chart for one embodiment of the "process data" algorithm 39. There are three memory variables used: CANE_LIFTED is a binary variable that is TRUE when the cane is lifted by the walker and FALSE at all other times; COUNTER is a byte variable that keeps track of how many process cycles have occurred with the cane leg loading above the unbalance threshold; and ALERT is a binary variable that is TRUE when the walker is being warned.

The process of FIG. 5 runs at the end of every cycle of the process shown in FIG. 3. Typically this may be 100 times per second. At the start of FIG. 5, the ALERT variable is tested to determine whether the warning device (a buzzer, for example) should be turned on or off. (The ALERT variable could have been set at the end of the previous cycle.) After this, the stored values just read from the load sensors are retrieved and added together. The result is compared to the cane weight; if it is less than that, CANE_LIFTED is set (TRUE) and COUNTER and ALERT are cleared. Among other things, this will cause the alarm buzzer to stop as soon as the walker lifts the cane.

If the sum of the stored values exceeds the cane weight, COUNTER is incremented and the process proceeds to calculate the differences between the values for each of the legs. This may be understood by considering the three legs 3*a,* 3*b* and 3*c,* in FIG. 1. When the cane is on level ground and at rest, the loads on 3*b* and 3*c* would be equal, indicating left-to-right stability; and the load distribution between 3*a* and (3*b*+3*c*) would have a value that indicates fore-and-aft stability. It we assume that the latter relationship is also equal, that is $3a=(3b+3c)$, the differences are calculated as: $\text{Diff.}=|3b-3c|+|3a-(3b+3c)|$. This indicates the total of left-to-right and fore-and-aft differences independent of their direction. If this is too great and lasts for too long, a warning should be sounded.

To test whether the differences last too long, the differences produced in each cycle are stored in memory locations pointed to by the value of COUNTER. When COUNTER reaches the value 10, the algorithm proceeds to retrieve the ten stored values and calculate an average. This is compared to a threshold level to decide whether to issue a warning, which is accomplished by setting the ALERT variable. It will be evident to one skilled in the art that many variations are possible in this algorithm and it is not the intention of this description to limit the invention to the one example shown here.

Typical values for the components of this system might be:

Microcomputer: Motorola 68HC705P6A

Load sensors: strain gages

Sense amplifiers: strain gage amplifiers

Warning device: vibrator

One skilled in the art will readily appreciate that many other configurations or components could be used to accomplish the objectives of this invention.

Although this invention has been disclosed and illustrated with reference to a particular embodiment for a walking cane, the principles involved are susceptible for use in numerous other situations, which will be apparent to persons skilled in the art. The invention is, therefore, to be limited only as indicated by the scope of the appended claims.

What is claimed is:

1. A walking cane comprising a handle, a vertical shaft and multiple legs, each of said legs equipped with electronic stress or load sensors, said electronic stress or load sensors coupled to an electronic processing module, said electronic processing module adapted to warn the cane user when the load distribution on the legs of the cane becomes abnormal or unbalanced while walking.

2. The device as set forth in claim 1 above, said electronic stress or load sensors comprising resistive strain gages.

3. The device as set forth in claim 1 above, said electronic processing module comprising a microprocessor.

4. The device as set forth in claim 1 above, wherein a vibrating device on the cane handle provides the warning to the cane user.

5. The device as set forth in claim 1 above, wherein an audible alarm device provides the warning to the cane user.

6. A walking cane comprising a handle, a vertical shaft, and multiple legs, means for detecting stress on said legs when the cane is placed on the ground, an electronic processing module coupled to said means for detecting stress so as to warn the cane user when loading of the legs is abnormal or unbalanced.

* * * * *